United States Patent [19]

Kimpel

[11] Patent Number: 4,728,917

[45] Date of Patent: Mar. 1, 1988

[54] ELECTROMAGNETIC RELAY WHEREIN RESPONSE VOLTAGE IS RENDERED TEMPERATURE INDEPENDENT

[75] Inventor: Rolf-Dieter Kimpel, Berlin, Fed. Rep. of Germany

[73] Assignee: Siemens Aktiengesellschaft, Berlin and Munich, Fed. Rep. of Germany

[21] Appl. No.: 1,049

[22] Filed: Jan. 7, 1987

[30] Foreign Application Priority Data

Jan. 16, 1986 [DE] Fed. Rep. of Germany ..... 3601113

[51] Int. Cl.[4] ..... H01F 7/08

[52] U.S. Cl. ..... 335/274; 335/78; 335/229

[58] Field of Search ..... 335/78, 79, 229, 230, 335/234, 274

[56] References Cited

U.S. PATENT DOCUMENTS

| | | | |
|---|---|---|---|
| 2,863,103 | 12/1958 | Tancred | 335/274 X |
| 2,896,132 | 7/1959 | Sauer | 335/274 X |
| 3,317,871 | 5/1967 | Adams | 335/230 |
| 3,522,564 | 8/1970 | Mori et al. | 335/78 X |
| 3,634,793 | 1/1972 | Sauer | 335/78 |
| 4,568,207 | 2/1986 | Hara et al. | 335/274 |

FOREIGN PATENT DOCUMENTS

| | | | |
|---|---|---|---|
| 1439210 | 1/1969 | Fed. Rep. of Germany | 335/274 |
| 972878 | 9/1950 | France | 335/274 |
| 1129189 | 9/1956 | France | 335/274 |
| 2396403 | 1/1979 | France | 335/274 |

*Primary Examiner*—George Harris

*Attorney, Agent, or Firm*—Hill, Van Santen, Steadman & Simpson

[57] ABSTRACT

A relay includes a permanent magnet for an armature restoring force having a highly negative temperature coefficient of remanence, where a portion of the permanent magnetic force is compensated by a compensation spring. The response voltage is rendered temperature independent by a heating means connected in parallel to the excitation winding to heat the permanent magnet in synchronization with the winding and, thus, guarantee a compensation of the response voltage with respect to the coil heating.

6 Claims, 2 Drawing Figures

ELECTROMAGNETIC RELAY WHEREIN RESPONSE VOLTAGE IS RENDERED TEMPERATURE INDEPENDENT

BACKGROUND OF THE INVENTION

1. Field of the Invention

The present invention relates to an electromagnetic relay having a permanent magnet to exert a force on an armature opposite a coil.

2. Description of the Prior Art

In German Pat. No. OS 1 439 210 is disclosed a relay having an excitation coil about a core with the yoke fastened to one end of the core and an armature forming a working air gap at the other end of the core. A permanent magnet is provided to exert a restoring force on the armature, at least by one pole of the magnet. Thus, a neutral, monostable magnet system is formed wherein the armature is attracted in opposition to the restoring force of the permanent magnet for the chronological duration of the coil excitation, and is returned to its quiescent position by the attraction of the permanent magnet upon discontinuation of the coil excitation.

The relay disclosed preferably includes a ceramic magnet as a restoring means, such ceramic magnets are also referred to as oxide magnets or ferrite magnets. Such magnets exhibit a relatively great temperature response. In particular, they have a temperature coefficient of remanence on the order of magnitude of $-2\times10^{-3}$°K$^{-1}$. This means that the permanent magnetic flux decreases with increasing temperature, the flux decreasing by about 10% for a temperature rise of 50° K. The negative temperature coefficient of the remanence of a permanent magnet is used in polarized, bistable relays to compensate the positive temperature coefficient of the coil resistance so that the response voltage increases less greatly for increasing temperatures than in an unpolarized relay. See, for example, Siemens Zeitschrift, 1969, pages 411–413.

In polarized relays, it is known to compensate a part of the permanent magnetic force by using springs to produce an optimum approximation of the temperature response of the permanent magnet to the temperature response of the coil. See, for example, German Pat. No. AS 1 902 610.

Since such relays are generally excited only by pulses, there is no significant intrinsic heating of the coil, and the temperature of the coil and the permanent magnet essentially correspond to the ambient temperature so that any temperature compensation of such bistable polarized relays is with respect to ambient temperature.

For a neutral magnetic system of the type described above, the monostable relay exhibits a high coil heating for longer duration excitations. Since the permanent magnet which provides an armature restoring force is at a distance from the heated coil and is largely at ambient temperature, the temperature compensation in the known polarized relays is not identically provided for such conditions.

SUMMARY OF THE PRESENT INVENTION

An object of the present invention is to provide a relay having temperature compensation of the response voltage during intrinsic heating of the coil.

This and other objects of the present invention are achieved in a relay having a compensation spring opposing the attractive force of a permanent magnet on an armature to compensate for a portion of the attractive force. The permanent magnet is in thermally conductive contact with a heating means which forms a part of the excitation circuit.

In the relay of the invention, a compensation spring is initially provided in order to transfer the known effects of temperature compensation to a neutral magnetic system. The part of the permanent magnetic force which must be compensated to achieve optimal adaptation of the temperature response of the permanent magnetic flux forces to the temperature response of the excitation flux forces can be calculated from known physical properties of the coil winding and of the permanent magnetic material being used. However, to achieve compensation for the coil heating which is beyond the compensation required for the ambient temperature influences, a heating means is provided to insure that the permanent magnet always is at the same temperature as the coil winding.

In the simplest case, the heating means is the excitation winding of the relay itself. The excitation winding is used when the permanent magnet is in thermal contact with the excitation winding as provided by the relay designed. In general, however, the restoring magnet is usually arranged opposite the coil in front of the armature so that this thermal contact is not possible without additional structures. In this case, it is expedient to provide a heating resistance as a heating means on the permanent magnet. The heating resistance is connected either in series or in parallel to the excitation circuit. The type of connection derives from the particular design of the excitation circuit and, more specifically, from the voltage applied thereto. Of course, the heating resistance is designed so that it generates heat for the permanent magnet which is similar to the heat of the coil winding. The heating resistance need not be provided as an additional component in many instances, since it is already desirable in such relays to limit peak voltages which occur upon disconnection of the winding inductance by using a parallel resistor. A heating resistance of the present invention can assume the function of such parallel resistor.

Structurally, one embodiment of the present relay includes a pole of the permanent magnet having a pole shoe which serves as an armature detent. A second pole of the permanent magnet is magnetically coupled to the core or to the yoke through a flux strap. By appropriately sizing the permanent magnet and the coupling, a switch behavior which corresponds more or less to that of a polarized relay is achieved.

When a neutral switch behavior is desired, then the permanent magnet includes a pole shoe at each of the two poles and the two pole shoes are bridged by the armature when the armature is then in the dropped-off, or quiescent, condition. Such arrangement provides a closed, permanent magnet circuit through the armature which is separated from the excitation circuit.

DESCRIPTION OF THE PREFERRED EMBODIMENTS

Figure 1:
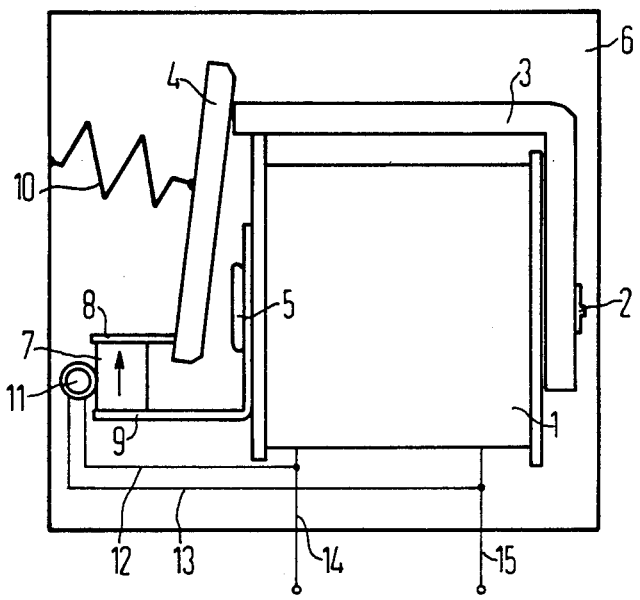
FIG. 1 is a schematic diagram of a temperature compensated angular armature relay according to the principles of the present invention, including a permanent magnet circuit coupled to a core.

A relay is shown in FIG. 1 including an excitation coil 1 having an axially arranged core 2, an angular yoke 3 coupled to one end of the core 2, and a flat armature 4 seated at a free end of the yoke 3 to form a working air gap with a pole plate 5 at a free end of the core 2. The relay magnet system is usually arranged on a pedestal or base 6, shown here diagrammatically as a rectangle. Of course, the relay also includes contact elements (not shown) which include, for example, a contact spring (not shown) connected to the armature 4 for interaction with the cooperating contact elements secured to the pedestal 6.

A restoring force is exerted on the armature 4 by a permanent magnet 7 which has a ferromagnetic pole shoe 8 forming a detent for the quiescent position of the armature 4. A second pole shoe 9 of the magnet 7 is magnetically coupled to the pole plate 5 of the core 2. As a result of the latter coupling, an approximation to the characteristic of a polarized relay derives in the switching behavior of the relay; however, the present invention is based on monostable switching behavior of the relay with a corresponding permanent magnet excitation and not necessarily on polarized relay switching. The magnet has a negative temperature coefficient of remanence on the order of magnitude of a ferrite magnet. In one embodiment, the temperature coefficient of remanence is $-2\times10^{-3}{}^{\circ}K^{-1}$.

A portion of the permanent magnetic flux force is compensated by the force of a compression spring 10 that is supported at one end by the pedestal 6. The spring 10 biases the armature 4 from the quiescent position in opposition to the attractive force of the permanent magnet 7. By appropriate dimensioning of the compression spring 10, a large portion of the permanent magnetic flux force is compensated so that the temperature response of the permanent flux force roughly corresponds to the temperature response of the excitation flux force resulting in the response voltage of the relay being largely constant, i.e. temperature compensated.

To guarantee that temperature compensation not only with respect to ambient temperature but also with respect to heating of the winding, a heating resistance 11 is provided immediately adjacent the permanent magnet 7. The heating resistance 11 is connected in parallel to winding connections 14 and 15 of the coil 1 through terminals 12 and 13. So long as the coil 1 is excited, the heating resistance 11 is also heated. The permanent magnet 7 is, thus, heated synchronously with the coil winding 2. In this way, the temperature compensation of the response voltage is guaranteed for every instance.

Figure 2:
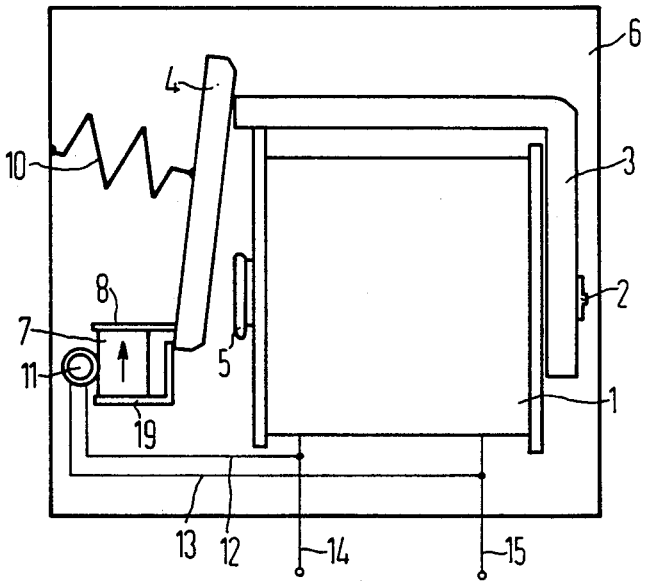
FIG. 2 is a schematic diagram of a relay of a second embodiment of the invention, including a separate permanent magnet circuit.

In FIG. 2, a slight modification of the relay of the present invention is shown. The fundamental structure, however, is the same, and corresponding parts are provided with identical reference numerals. A modified pole shoe 19 is provided for the permanent magnet 7 in place of the pole shoe 9. The pole shoe 19 is not coupled to the core 2 but is formed so that the armature 4 presses against both pole shoes 8 and 19 when the armature 4 is in its quiescent condition to form a closed permanent magnetic circuit. In this case, the neutral switch behavior of the magnet system is not modified due to the permanent magnet; however, the same temperature compensation as in the embodiment of FIG. 1 is guaranteed by the heating resistance 11.

Although other modifications and changes may be suggested by those skilled in the art, it is the intention of the inventor to embody within the patent warranted hereon all changes and modifications as reasonably and properly come within the scope of his contribution to the art.

I claim as my invention

1. In an electromagnetic relay having an excitation coil about a core and a yoke having one end coupled to an end of the core, an armature forms a working air gap with an opposite end of the core, the improvement comprising:

a permanent magnet mounted to exert a restoring force on the armature by at least one pole of said magnet, said permanent magnet having a negative temperature coefficient of remanence on the order of magnitude of a ferrite magnet;

a compensating spring opposing the attractive restoring force of said permanent magnet on the armature; and means for heating being in thermally conductive contact with said permanent magnet, said heating means forming a part of an excitation circuit of the relay.

2. An electromagnetic relay as claimed in claim 1, wherein said heating means is the excitation winding of the relay.

3. An electromagnetic relay as claimed in claim 1, wherein said heating means is a heating resistance connected in the excitation circuit.

4. An electromagnetic relay as claimed in claim 1, wherein said permanent magnet has first and second poles, said first pole includes a pole shoe forming an armature detent, a flux strap coupling said second pole to at least one of said core and said yoke.

5. An electromagnetic relay as claimed in claim 1, further comprising:

a pole shoe at each of two poles of said permanent magnet, both of said pole shoes being bridged by the armature when the armature is in a quiescent condition.

6. An electromagnetic relay, comprising:

a core having first and second opposite ends;

an excitation coil around said core and connectable to electric power to generate electromagnetic force;

a yoke having a first end connected at said first end of said core, said yoke extending along said excitation coil substantially parallel to said coil;

an armature pivotally mounted against said yoke and forming a working air gap with said second end of said core, said armature being pivotable toward said second end of said core upon excitation of said excitation coil;

a permanent magnet mounted to exert a force on said armature opposite the effect of said excitation coil; and a heating resistor in thermal contact with said permanent magnet and connected in circuit with said excitation coil.

* * * * *